United States Patent [19]

Drueck, Jr.

[11] Patent Number: 4,682,726

[45] Date of Patent: Jul. 28, 1987

[54] PENTAGONAL DODECAHEDRON

[76] Inventor: Fred Drueck, Jr., 4941 W. Henderson, Chicago, Ill. 60641

[21] Appl. No.: 920,686

[22] Filed: Oct. 20, 1986

[51] Int. Cl.[4] ..... B65D 5/36

[52] U.S. Cl. ..... 229/108; 229/23 R; 229/41 C

[58] Field of Search ..... 229/108, 109, 110, 111, 229/117, 41 B, 41 C, 41 R, 23 R, DIG. 9

[56] References Cited

U.S. PATENT DOCUMENTS

| | | | |
|---|---|---|---|
| 1,649,088 | 11/1927 | Tinsley | 229/108 |
| 1,720,146 | 7/1929 | Reese | 229/41 C |
| 2,320,665 | 6/1943 | Shearer | 229/109 |
| 2,706,592 | 4/1955 | Schaller | 229/41 C |
| 2,751,138 | 6/1956 | Laver | 229/109 |
| 3,204,849 | 9/1965 | Vinney | 229/41 C |
| 3,666,607 | 5/1972 | Weissman | 229/108 |
| 4,607,785 | 8/1986 | Croley | 229/110 |

*Primary Examiner*—Willis Little

*Attorney, Agent, or Firm*—Robert E. Knechtel; Basil E. Demeur

[57] ABSTRACT

A collapsible, self-erecting pentagonal dodecahedron hollow structure formed from two integral blanks of paperboard, each of which is cut and scored to form a central pentagonal having integrally formed therewith five other generally pentagonal walls which are affixed to the respective ones of the edges of the central pentagonal by a score line. Each of the generally pentagonal walls has a triangular flap which is hingedly affixed by means of a score line along one of its edges so as to be disposed between adjacent ones of the pentagonal walls. A slide member is affixed to each of the triangular flaps and is disposed to extend beneath the adjacent pentagonal wall. Each of the pentagonal walls of one of the blanks has a foldable attachment flap affixed by a score line to the outwardmost edge thereof. Each of the pentagonal walls of the other one of the blanks has a foldable hook flap affixed by a score line to the outwardmost edge thereof. An elastic means such as a rubber band engages a hook on each of the foldable hook flaps. The two blanks are affixed together atop one another by means of rivets or the like such as to permit rotation of the pentagonal walls with respect to one another. The hollow structure is collapsed in this configuration, but when released will automatically self-erect to form the hollow pentagonal dodecahedron.

6 Claims, 8 Drawing Figures

PENTAGONAL DODECAHEDRON

This invention relates to a collapsible, self-erecting hollow structure, particularly a pentagonal dodecahedron hollow structure.

In co-pending application Ser. No. 736,854, filed May 22, 1985, there is disclosed several self-erecting hollow structures, each of which is formed from an integral blank of paperboard which is cut and scored to form a plurality of side and end walls which when erected form the hollow structure. Other collapsible, self-erecting hollow structures are disclosed in U.S. Pat. Nos. 822,841; 888,774; and 3,234,682.

The pentagonal dodechahedron hollow structure of the present invention is formed from two integral blanks of paperboard, each of which is cut and scored to form a central pentagonal having integrally formed therewith five other generally pentagonal walls which are affixed to the respective ones of the edges of the central pentagonal by a score line. Each of the generally pentagonal walls has a triangular flap which is hingedly affixed by means of a score line along one of its edges so as to be disposed between adjacent ones of the pentagonal walls. A slide member is affixed to each of the triangular flaps and is disposed to extend beneath the adjacent pentagonal wall.

Each of the pentagonal walls of one of the blanks has a foldable attachment flap affixed by a score line to the outwardmost edge thereof. Each of the pentagonal walls of the other one of the blanks has a foldable hook flap affixed by a score line to the outwardmost edge therof.

An elastic means such as a rubber band engages a hook on each of the foldable hook flaps.

The two blanks are affixed together atop one another by means of rivets or the like such as to permit rotation of the pentagonal walls with respect to one another. The hollow structure is collapsed in this configuration, but when released will automatically self-erect to form the hollow pentagonal dodecahedron.

Indicia such as advertising material or the like can be applied to the surfaces of the pentagonal walls to provide an attractive advertising device. The elastic means is totally concealed within the erected hollow structure so that the surfaces of the pentagonal walls are not obstructed.

DESCRIPTION OF A PREFERRED EMBODIMENT

Figure 1:
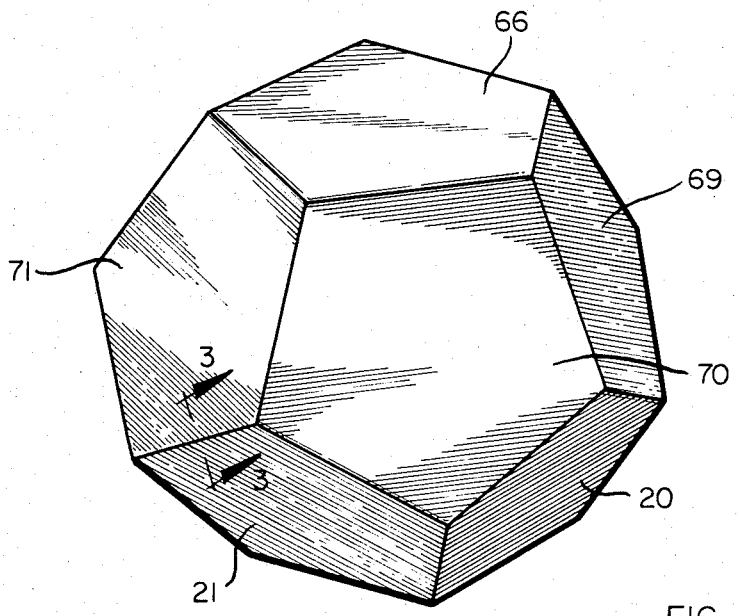
FIG. 1 is a perpsective view of the collapsible, self-erecting hollow structure of the invention.
Figure 2:
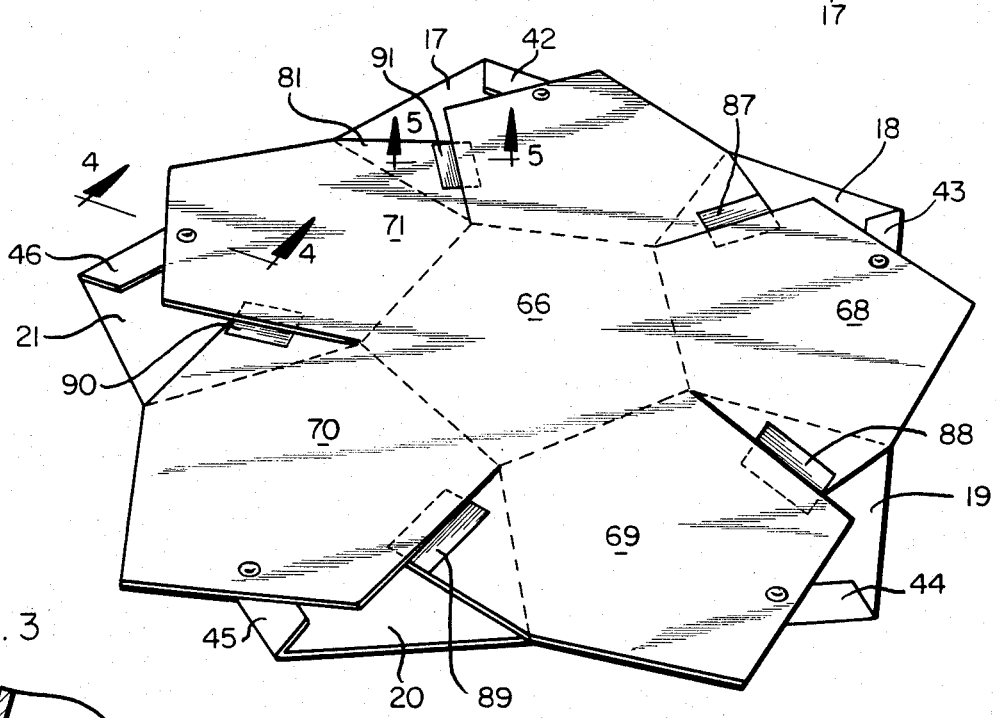
FIG. 2 is a perspective view illustrating the manner in which the hollow structure is collapsed for shipping and/or storage.
Figure 3:
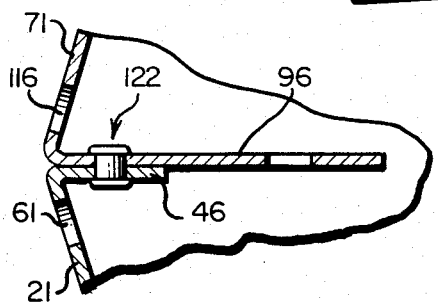
FIG. 3 is a sectional view taken along lines 3—3 of FIG. 1.

Referring now to the drawings, in FIG. 1 there is illustrated a pentagonal dodecahedron hollow structure 10 which is formed from a pair of integral blanks 12 and 14 (FIGS. 7 and 8) of paperboard material. The hollow structure 10 can be collapsed as illustrated in FIG. 2, and when released will automatically self-erect to form the pentagonal dodecahedron illustrated in FIG. 1.

Figure 7:
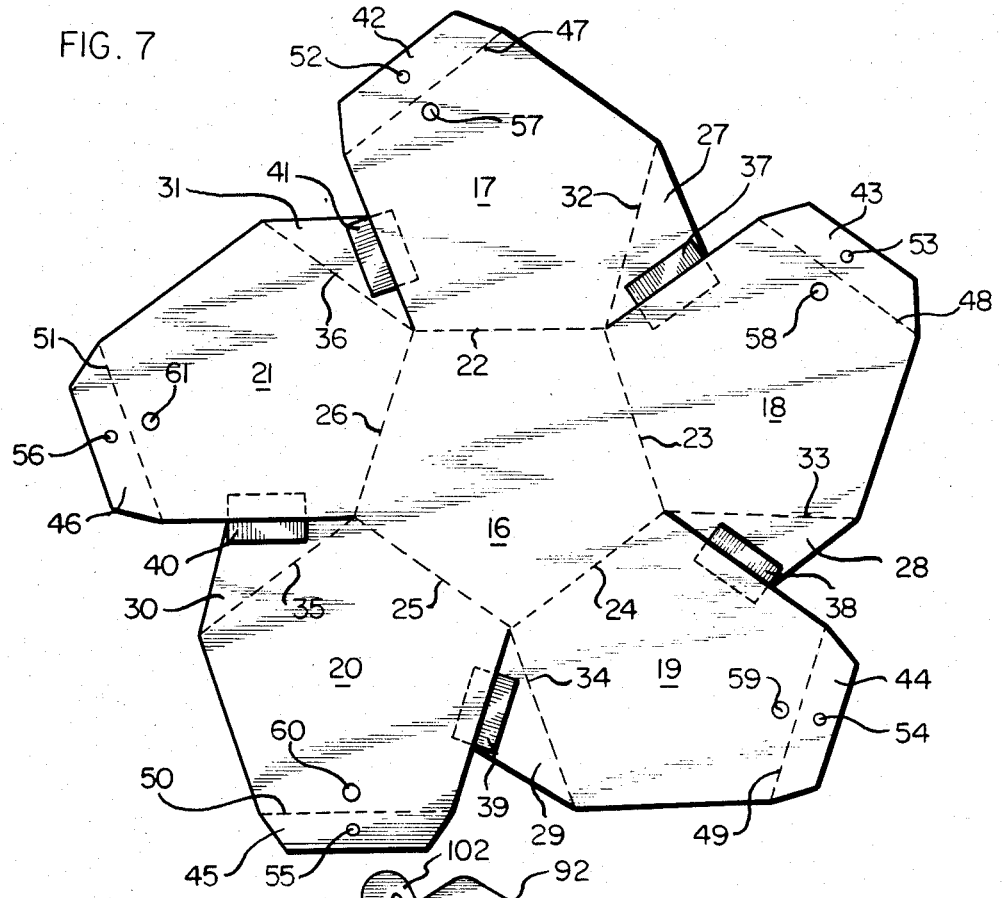
FIG. 7 is a plan view of one of the blanks from which the hollow structure of FIG. 1 is formed.

More particularly, in FIG. 7 it can be seen that the blank 12 is cut and scored to form a pentagonal central wall 16 having five similar pentagonal walls 17–21 affixed to each of its edges. The pentagonal central wall 16 is defined by the score lines 22–26, and each of the pentagonal walls 17–21 is affixed to the pentagonal central wall 16 along these score lines.

A triangular flap 27–31 is integrally affixed by the respective ones of the score lines 32–36 to the respective ones of the pentagonal walls 17–21. A slide member 37–41 is affixed to the respective ones of the triangular flaps 27–31, and are disposed to extend beneath its adjacent pentagonal wall.

A foldable attachment flap 42–46 is affixed by means of a score line 47–51 to the respective ones of the pentagonal walls 17–21. A small rivet hole 52–56 is formed in the respective ones of the attachment flaps 42–46, while a larger hole 57–61 is formed in the respective ones of the pentagonal walls 17–21. The holes 52–56 and 57–61 are disposed so as to overlap one another when the foldable attachment flaps 42–46 are folded over atop the pentagonal walls 17–21. The holes 52–56 are sufficiently large to receive a rivet, and the holes 57–61 are sufficiently large to receive a rivet head, all as more specifically described below.

Figure 8:
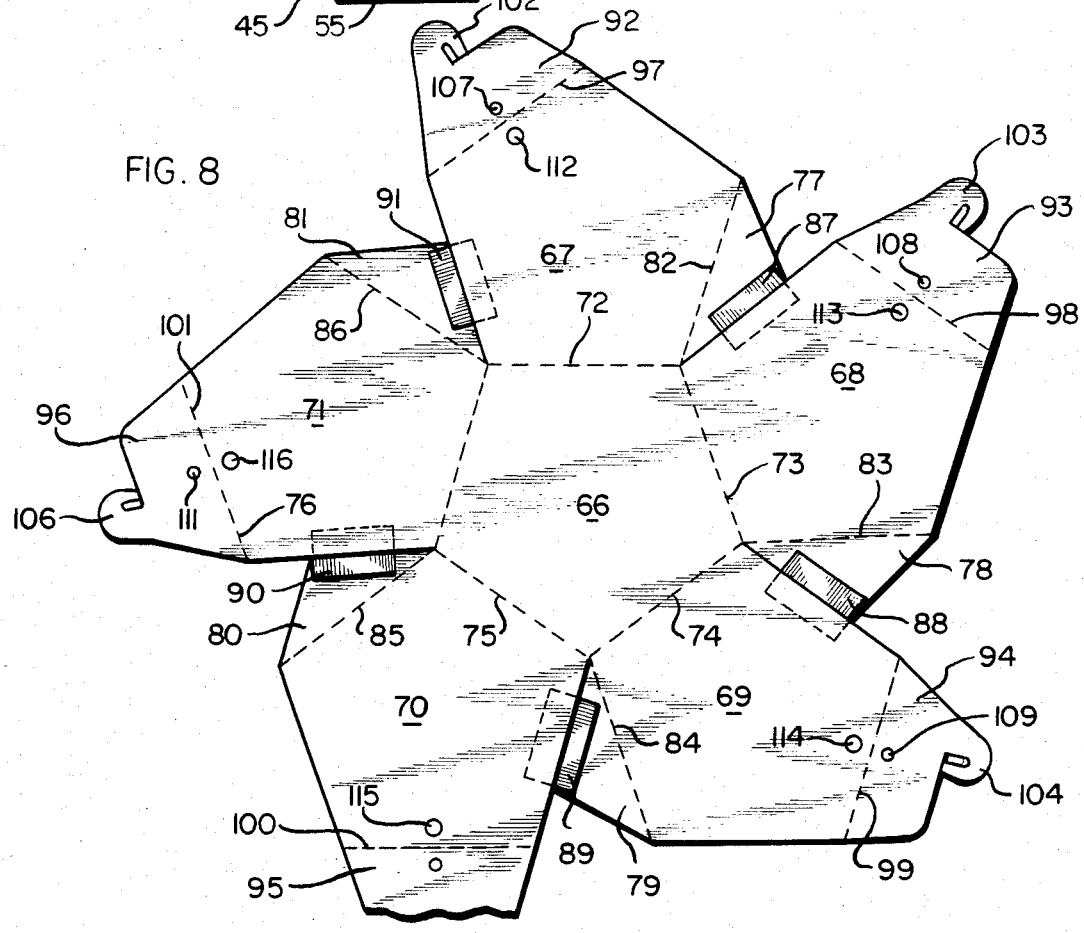
FIG. 8 is a plan view of the other one of the blanks from which the hollow structure of FIG. 1 is formed.

In FIG. 8, it can be seen that the blank 14 is cut and scored substantially like the blank 12 to form a pentagonal central wall 66 having five pentagonal walls 67–71 affixed by score lines 72–76 to the edges of the pentagonal cenrtral wall 66; and triangular flaps 77–81 which are affixed to the respective ones of the pentagonal walls 67–71 by means of score lines 82–86. A slide member 87–91 is affixed to the respective ones of the triangular flaps 77–81 and is disposed to extend beneath the adjacent one of the pentagonal walls.

The distinction between the blanks 12 and 14 is that the pentagonal walls 67–71 are formed with foldable hook flaps 92–96 which are affixed to them by means of score lines 97–101. These hook flaps 92–96 each have a hook member 102–106.

A small hole 107–111 is formed in the respective ones of the hook flaps 92–96, and a larger hole 112–116 is formed in the respective ones of the pentagonal walls 67–71. In this case also, the holes 107–111 and 112–116 overlap when the hook flaps 92–96 are folded over atop the pentagonal walls 67–71, and the holes 107–111 and 112–116 are sufficiently large to receive a rivet and a rivet head respectively.

Figure 4:
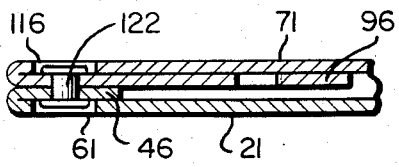
FIG. 4 is a sectional view taken along lines 4—4 of FIG. 2.
Figure 6:
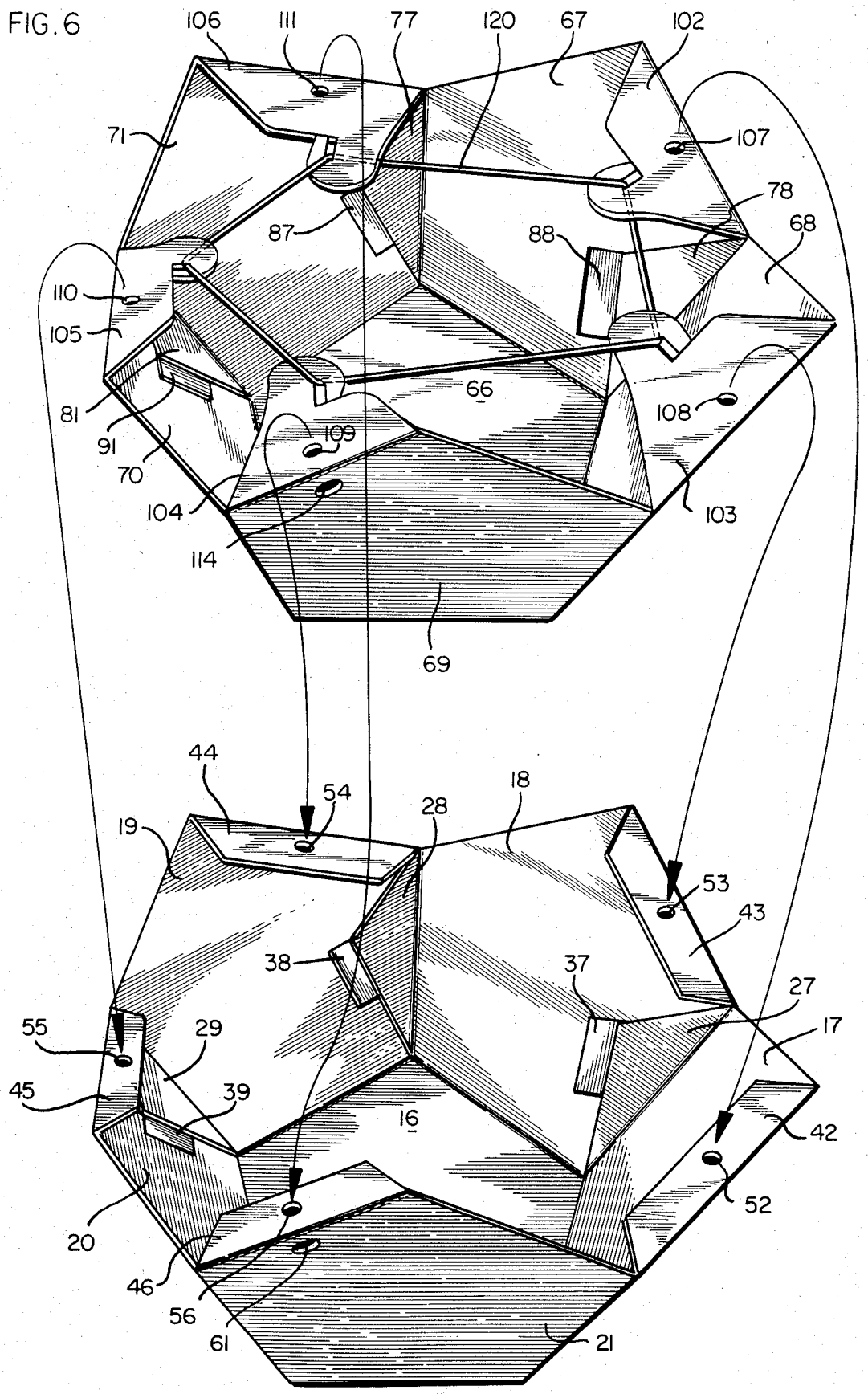
FIG. 6 is an exploded perspective view generally illustrating the manner in which the hollow structure of FIG. 1 is assembled.

The blanks 12 and 14 are affixed together atop one another as generally illustrated in FIGS. 2 and 6. The attachment flaps 42–46 and the hook flaps 92–96 are folded over atop the pentagonal walls 17–21 and 67–71, respectively, such that they all are disposed in the interior of the pentagonal dodecahedron when it is erected. An elastic means 120 such as a rubber band is engaged with the hook members 102–106, as illustrated in FIG. 6. The blanks 12 and 14 are laid flat atop one another as illustrated in FIG. 2, and rivets such as the rivet 122 are extended through the larger holes 57–61 in the pentagonal walls 17–61, through the smaller holes 52–56 in the attachment flaps 42–46, through the smaller holes 107–111 in the hook flaps 92–96 and through the larger holes 112–116 in the pentagonal walls 67–71, as can be best seen in FIG. 4. It may be noted that the rivets 122 secure the attachment and hook flaps together, but the heads of the rivets are freely disposed in the larger holes in the pentagonal walls. Also, the smaller holes and the rivets are proportioned and the rivets are set, so that rotation between the flaps secured together is possible.

Figure 5:
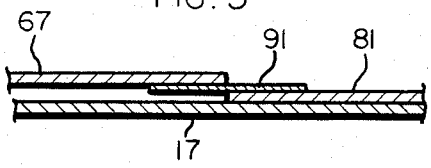
FIG. 5 is a sectional view taken along lines 5—5 of FIG. 2.

Also, as can be seen in FIGS. 2, 5 and 6, the slide members 37–41 and 87–91 all are disposed beneath the pentagonal wall which is adjacent to it and such that they all are disposed on the interior of the pentagonal dodecahedron when it is erected. It is preferred to provide the slide members to assure that the triangular flaps 27–31 and 77–81 slidably engage behind the adjacent pentagonal wall when the hollow structure 10 self-erects, but they could be eliminated if desired. In most cases, the triangular flaps will slidably engage behind the pentagonal walls, but the slide members assure that they do. The slide members 37–41 and 87–91 can be simply rectangular-shaped pieces of a heavy weight paper or the like adhesively or otherwise affixed to the triangular flaps 27–31 and 77–86. The triangular flaps 27–31 and 77–86 function to shape the hollow structure 10 when it is self-erecting.

When the hollow structure 10 is assembled as described above, and is illustrated in FIG. 2, it is in a collapsed form or shape and may be packaged, stored or shipped in this configuration. There is a normal tendency for the hollow structure 10 to self-erect when it is not contained in a flattened configuration; hence when it is removed from its packaging, it will automatically self-erect to the pentagonal dodecahedron shape illustrated in FIG. 1. When the hollow structure 10 self-erects, the elastic member 120, the triangular flaps 27–31 and 77–81, the attachment flaps 42–46 and the hook flaps 87–91 all are disposed within its interior. Accordingly, only the pentagonal walls are visible, with the manner in which the hollow structure 10 is erected being concealed. When advertising indicia or the like is affixed to the pentagonal walls, a unique, attractive advertising device or the like can be provided.

What is claimed is:

1. A collapsible, self-erecting closed hollow structure in the form of a pentagonal dodecahedron formed from a pair of integral blanks of paperboard each of which is cut and scored to form a pentagonal central wall having a pentagonal wall affixed to each of its respective side edges, each of said pentagonal walls of one of said blanks having a foldable attachment flap integrally affixed to a radial edge thereof, each of said pentagonal walls of the other one of said blanks having a foldable hook flap having a hook integrally formed therewith integrally affixed to a radial edge thereof;

said attachment flaps and said hook flaps being foldable to overlie its associated pentagonal flap, means for securing the respective ones of said attachment flaps to said hook flaps for rotation therebetween when one of said blanks is disposed atop the other one of said blanks with said attachment flaps and hook flaps disposed between them, elastic means secured under tension to said hooks of said hook flaps, said elastic means normally pulling said hook flaps toward one another and thereby erecting said closed hollow structure.

2. The collapsible, self-erecting closed hollow structure of claim 1, each of said pentagonal walls of said pair of blanks having affixed thereto along one edge thereof a foldable triangular flap, said foldable triangular flaps when said hollow structure is erected being slidably disposed behind an adjacent pentagonal wall to assist in shaping and forming said hollow structure.

3. The collapsible, self-erecting closed hollow structure of claim 2 further comprising a slide member affixed to the respective one of said triangular flaps and disposed behind the pentagonal wall adjacent to it, said slide members functioning to dispose said triangular members behind said adjacent pentagonal walls when said hollow structure self-erects.

4. The collapsible, self-erecting hollow structure of claim 3, wherein said atachment flaps and said hook flaps are secured to one another for rotation therebetween by means of rivets, said rivets having a body portion and a head portion.

5. The collapsible, self-erecting hollow structure of claim 4, wherein said pentagonal walls having an aperture therein for receiving said head portion of said rivets.

6. The collapsible, self-erecting hollow structure of claim 5, further comprising indicia affixed to the surfaces of said pentagonal walls.

* * * * *